US008222836B2

(12) United States Patent
Jin

(10) Patent No.: US 8,222,836 B2
(45) **Date of Patent: *Jul. 17, 2012**

(54) BALANCING TRANSFORMERS FOR MULTI-LAMP OPERATION

(75) Inventor: Xiaoping Jin, Orange, CA (US)

(73) Assignee: Microsemi Corporation, Irvine, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/084,229

(22) Filed: Apr. 11, 2011

(65) Prior Publication Data

US 2011/0181204 A1 Jul. 28, 2011

Related U.S. Application Data

(63) Continuation of application No. 12/497,401, filed on Jul. 2, 2009, now Pat. No. 7,932,683, which is a continuation of application No. 11/937,693, filed on Nov. 9, 2007, now Pat. No. 7,560,875, which is a continuation of application No. 10/959,667, filed on Oct. 5, 2004, now Pat. No. 7,294,971.

(60) Provisional application No. 60/508,932, filed on Oct. 6, 2003.

(51) Int. Cl.
*H05B 37/02* (2006.01)

(52) U.S. Cl. ..... 315/307; 315/276; 315/277; 315/308

(58) Field of Classification Search ..... 315/276, 315/277, 278, 224, 225, 246, 247, 307, 308, 315/312, 324, 119, 128, 127
See application file for complete search history.

(56) References Cited

U.S. PATENT DOCUMENTS

| | | | |
|---|---|---|---|
| 2,429,162 | A | 10/1947 | Keiser et al. |
| 2,440,984 | A | 5/1948 | Summers |
| 2,572,258 | A | 10/1951 | Goldfield et al. |
| 2,965,799 | A | 12/1960 | Brooks et al. |
| 2,968,028 | A | 1/1961 | Goto et al. |
| 3,141,112 | A | 7/1964 | Eppert |
| 3,565,806 | A | 2/1971 | Ross |
| 3,597,656 | A | 8/1971 | Douglas |
| 3,611,021 | A | 10/1971 | Wallace |
| 3,676,734 | A | 7/1972 | Shimizu et al. |
| 3,683,923 | A | 8/1972 | Anderson |

(Continued)

FOREIGN PATENT DOCUMENTS

EP 0326114 8/1989

(Continued)

OTHER PUBLICATIONS

Bradley, D.A., "Power Electronics" 2nd Edition; Chapman & Hall, 1995; Chapter 1, pp. 1-38.

(Continued)

*Primary Examiner* — David Hung Vu
(74) *Attorney, Agent, or Firm* — Knobbe Martens Olson & Bear, LLP

(57) ABSTRACT

A ring balancer comprising a plurality of balancing transformers facilitates current sharing in a multi-lamp backlight system. The balancing transformers have respective primary windings separately coupled in series with designated lamps and have respective secondary windings coupled together in a closed loop. The secondary windings conduct a common current and the respective primary windings conduct proportional currents to balance currents among the lamps. The ring balancer facilitates automatic lamp striking and the lamps can be advantageously driven by a common voltage source.

20 Claims, 11 Drawing Sheets

U.S. PATENT DOCUMENTS 3,737,755 A 6/1973 Calkin et al.
3,742,330 A 6/1973 Hodges et al.
3,936,696 A 2/1976 Gray
3,944,888 A 3/1976 Clark
4,051,410 A 9/1977 Knoble
4,060,751 A 11/1977 Anderson
4,353,009 A 10/1982 Knoll
4,388,562 A 6/1983 Josephson
4,441,054 A 4/1984 Bay
4,463,287 A 7/1984 Pitel
4,523,130 A 6/1985 Pitel
4,562,338 A 12/1985 Okami
4,567,379 A 1/1986 Corey et al.
4,572,992 A 2/1986 Masaki
4,574,222 A 3/1986 Anderson
4,622,496 A 11/1986 Dattilo et al.
4,630,005 A 12/1986 Clegg et al.
4,663,566 A 5/1987 Nagano
4,663,570 A 5/1987 Luchaco et al.
4,672,300 A 6/1987 Harper
4,675,574 A 6/1987 Delflache
4,686,615 A 8/1987 Ferguson
4,698,554 A 10/1987 Stupp et al.
4,700,113 A 10/1987 Stupp et al.
4,761,722 A 8/1988 Pruitt
4,766,353 A 8/1988 Burgess
4,780,696 A 10/1988 Jirka
4,847,745 A 7/1989 Shekhawat
4,862,059 A 8/1989 Tominaga et al.
4,893,069 A 1/1990 Harada et al.
4,902,942 A 2/1990 El-Hamamsy et al.
4,912,372 A 3/1990 Mongoven et al.
4,939,381 A 7/1990 Shibata
5,023,519 A 6/1991 Jensen
5,030,887 A 7/1991 Guisinger
5,036,255 A 7/1991 McKnight et al.
5,057,808 A 10/1991 Dhyanchand
5,173,643 A 12/1992 Sullivan et al.
5,349,272 A 9/1994 Rector
5,434,477 A 7/1995 Crouse et al.
5,475,284 A 12/1995 Lester et al.
5,485,057 A 1/1996 Smallwood et al.
5,519,289 A 5/1996 Katyl et al.
5,539,281 A 7/1996 Shackle et al.
5,557,249 A 9/1996 Reynal
5,563,473 A 10/1996 Mattas et al.
5,574,335 A 11/1996 Sun
5,574,356 A 11/1996 Parker
5,615,093 A 3/1997 Nalbant
5,619,402 A 4/1997 Liu
5,621,281 A 4/1997 Kawabata et al.
5,652,479 A 7/1997 LoCascio et al.
5,712,776 A 1/1998 Palara et al.
5,754,012 A 5/1998 LoCascio
5,818,172 A 10/1998 Lee
5,822,201 A 10/1998 Kijima
5,825,133 A 10/1998 Conway
5,828,156 A 10/1998 Roberts
5,854,617 A 12/1998 Lee et al.
5,892,336 A 4/1999 Lin et al.
5,910,713 A 6/1999 Nishi et al.
5,912,812 A 6/1999 Moriarty, Jr. et al.
5,914,842 A 6/1999 Sievers
5,923,129 A 7/1999 Henry
5,930,121 A 7/1999 Henry
5,930,126 A 7/1999 Griffin et al.
5,936,360 A 8/1999 Kaneko
6,002,210 A 12/1999 Nilssen
6,020,688 A 2/2000 Moisin
6,028,400 A 2/2000 Pol et al.
6,037,720 A 3/2000 Wong et al.
6,038,149 A 3/2000 Hiraoka et al.
6,040,662 A 3/2000 Asayama
6,043,609 A 3/2000 George et al.
6,049,177 A 4/2000 Felper
6,072,282 A 6/2000 Adamson
6,104,146 A 8/2000 Chou et al.
6,108,215 A 8/2000 Kates et al.
6,114,814 A 9/2000 Shannon et al.
6,121,733 A 9/2000 Nilssen
6,127,785 A 10/2000 Williams
6,127,786 A 10/2000 Moison
6,137,240 A 10/2000 Bogdan
6,150,772 A 11/2000 Crane
6,169,375 B1 1/2001 Moisin
6,181,066 B1 1/2001 Adamson
6,181,083 B1 1/2001 Moisin
6,181,084 B1 1/2001 Lau
6,188,553 B1 2/2001 Moisin
6,198,234 B1 3/2001 Henry
6,198,236 B1 3/2001 O'Neill
6,215,256 B1 4/2001 Ju
6,218,788 B1 4/2001 Chen et al.
6,259,615 B1 7/2001 Lin
6,281,636 B1 8/2001 Okutsu et al.
6,281,638 B1 8/2001 Moisin
6,307,765 B1 10/2001 Choi
6,310,444 B1 10/2001 Chang
6,316,881 B1 11/2001 Shannon et al.
6,320,329 B1 11/2001 Wacyk
6,323,602 B1 11/2001 De Groot et al.
6,344,699 B1 2/2002 Rimmer
6,362,577 B1 3/2002 Ito et al.
6,396,722 B2 5/2002 Lin
6,417,631 B1 7/2002 Chen et al.
6,420,839 B1 7/2002 Chiang et al.
6,433,492 B1 8/2002 Buonavita
6,441,943 B1 8/2002 Roberts et al.
6,445,141 B1 9/2002 Kastner et al.
6,459,215 B1 10/2002 Nerone et al.
6,459,216 B1 10/2002 Tsai
6,469,454 B1 10/2002 Mader et al.
6,469,922 B2 10/2002 Choi
6,472,827 B1 10/2002 Nilssen
6,472,876 B1 10/2002 Notohamiprodjo et al.
6,486,618 B1 11/2002 Li
6,494,587 B1 12/2002 Shaw et al.
6,501,234 B2 12/2002 Lin et al.
6,509,696 B2 1/2003 Bruning et al.
6,515,427 B2 2/2003 Oura et al.
6,515,881 B2 2/2003 Chou et al.
6,522,558 B2 2/2003 Henry
6,531,831 B2 3/2003 Chou et al.
6,534,934 B1 3/2003 Lin et al.
6,559,606 B1 5/2003 Chou et al.
6,570,344 B2 5/2003 Lin
6,628,093 B2 9/2003 Stevens
6,633,138 B2 10/2003 Shannon et al.
6,680,834 B2 1/2004 Williams
6,717,372 B2 4/2004 Lin et al.
6,765,354 B2 7/2004 Klein
6,781,325 B2 8/2004 Lee
6,784,627 B2 8/2004 Suzuki et al.
6,804,129 B2 10/2004 Lin
6,864,867 B2 3/2005 Biebl
6,870,330 B2 3/2005 Choi
6,922,023 B2 7/2005 Hsu et al.
6,930,893 B2 8/2005 Vinciarelli
6,936,975 B2 8/2005 Lin et al.
6,936,977 B2 * 8/2005 Moisin ..... 315/282
7,242,147 B2 7/2007 Jin
7,265,499 B2 9/2007 Ball
7,294,971 B2 11/2007 Jin
7,560,875 B2 7/2009 Jin
2001/0036096 A1 11/2001 Lin
2002/0030451 A1 3/2002 Moisin
2002/0097004 A1 7/2002 Chiang et al.
2002/0135319 A1 9/2002 Bruning et al.
2002/0140538 A1 10/2002 Yer
2002/0145886 A1 10/2002 Stevens
2002/0171376 A1 11/2002 Rust et al.
2002/0180380 A1 12/2002 Lin
2002/0180572 A1 12/2002 Kakehashi et al.
2002/0181260 A1 12/2002 Chou et al.
2002/0195971 A1 12/2002 Qian et al.
2003/0001524 A1 1/2003 Lin et al.
2003/0015974 A1 1/2003 Klier et al.

| | | | |
|---|---|---|---|
| 2003/0080695 | A1 | 5/2003 | Ohsawa |
| 2003/0090913 | A1 | 5/2003 | Che-Chen et al. |
| 2003/0117084 | A1 | 6/2003 | Stack |
| 2003/0141829 | A1 | 7/2003 | Yu |
| 2004/0000879 | A1 | 1/2004 | Lee |
| 2004/0032223 | A1 | 2/2004 | Henry |
| 2004/0155596 | A1 | 8/2004 | Ushijima |
| 2004/0257003 | A1 | 12/2004 | Hsieh et al. |
| 2004/0263092 | A1 | 12/2004 | Liu |
| 2005/0093471 | A1 | 5/2005 | Jin |
| 2005/0093472 | A1 | 5/2005 | Jin |
| 2005/0093482 | A1 | 5/2005 | Ball |
| 2005/0093483 | A1 | 5/2005 | Ball |
| 2005/0093484 | A1 | 5/2005 | Ball |
| 2005/0099143 | A1 | 5/2005 | Kohno |
| 2005/0156539 | A1 | 7/2005 | Ball |
| 2005/0162098 | A1 | 7/2005 | Ball |
| 2005/0225261 | A1 | 10/2005 | Jin |
| 2006/0022612 | A1 | 2/2006 | Henry |
| 2009/0267521 | A1 | 10/2009 | Jin |

FOREIGN PATENT DOCUMENTS

| | | | |
|---|---|---|---|
| EP | 0587923 | | 3/1994 |
| EP | 0597661 | | 5/1994 |
| EP | 0647021 | | 9/1994 |
| EP | 0766500 | | 4/1997 |
| EP | 0 838 272 | A2 | 4/1998 |
| JP | 5-90897 | | 12/1993 |
| JP | 06168791 | A | 6/1994 |
| JP | H06-181095 | A | 6/1994 |
| JP | 8-204488 | | 8/1996 |
| JP | H09-161980 | | 6/1997 |
| JP | H10-128237 | A | 5/1998 |
| JP | H11-238589 | A | 8/1999 |
| JP | 11305196 | A | 11/1999 |
| JP | 2000-030880 | A | 1/2000 |
| JP | 2002-367835 | A | 12/2002 |
| JP | 2003-31383 | A | 1/2003 |
| TW | 485701 | | 5/2002 |
| TW | 556860 | | 1/2003 |
| TW | 200554643 | | 9/2003 |
| TW | 200501829 | | 1/2005 |
| WO | WO 94/15444 | | 7/1994 |
| WO | WO 96/38024 | | 11/1996 |

OTHER PUBLICATIONS

Chinese Office Action for Application No. 2004800348936, dated May 22, 2009.

Dubey, G. K., "Thyristorised Power Controllers"; Halsted Press, 1986; pp. 74-77.

Examination Report for Application No. EP 04794179, dated Oct. 16, 2007.

First Office Action for Korean Patent Application No. 10-2006-7006590, dated Feb. 18, 2011 in 4 pages.

Notice of Reasons for Rejection for Japanese Patent Application No. 2006-534250, dated Apr. 13, 2010 in 6 pages.

Supplementary European Search Report for Application No. EP 04794179, dated May 15, 2007.

Taiwan Examination Report for Application No. 094110958, dated Mar. 20, 2008.

Williams, B.W., "Power Electronics Devices, Drivers, Applications and Passive Components"; Second Edition, McGraw-Hill, 1992; Chapter 10, pp. 218-249.

* cited by examiner

BALANCING TRANSFORMERS FOR MULTI-LAMP OPERATION

CLAIM FOR PRIORITY

This application is a continuation of U.S. application Ser. No. 12/497,401, filed on Jul. 2, 2009, entitled BALANCING TRANSFORMERS FOR MULTI-LAMP OPERATION, now U.S. Pat. No. 7,932,683, which is a continuation of U.S. application Ser. No. 11/937,693, filed on Nov. 9, 2007, entitled BALANCING TRANSFORMERS FOR MULTI-LAMP OPERATION, now U.S. Pat. No. 7,560,875, which is a continuation of U.S. application Ser. No. 10/959,667, filed on Oct. 5, 2004 and entitled BALANCING TRANSFORMERS FOR RING BALANCER, now U.S. Pat. No. 7,294,971, which claims the benefit of priority under 35 U.S.C. §119(e) of U.S. Provisional Application No. 60/508,932, filed on Oct. 6, 2003 and entitled A CURRENT SHARING SCHEME AND SHARING DEVICES FOR MULTIPLE CCF LAMP OPERATION, the entirety of each of which is incorporated herein by reference.

BACKGROUND OF THE INVENTION

1. Field of the Invention

The present invention relates generally to balancing transformers and more particularly to a ring balancer used for current sharing in a multi-lamp backlight system.

2. Description of the Related Art

In liquid crystal display (LCD) applications backlight is needed to illuminate the screen to make a visible display. With the increasing size of LCD display panels (e.g., LCD television or large screen LCD monitor), cold cathode fluorescent lamp (CCFL) backlight systems may operate with multiple lamps to obtain high quality illumination for the display. One of the challenges to a multiple lamp operation is how to maintain substantially equal or controlled operating currents for the respective lamps, thereby yielding the desired illumination effect on the display screen, while reducing electronic control and power switching devices to reduce system cost. Some of the difficulties are discussed below.

The variation in operating voltage of a CCFL is typically around ±20% for a given current level. When multiple lamps are connected in parallel across a common voltage source, equal current sharing among the lamps is difficult to achieve without a current balancing mechanism. Moreover, lamps with higher operating voltages may not ignite after ignition of lower operating voltage lamps.

In constructing a display panel with multiple lamps, it is difficult to provide identical surrounding conditions for each lamp. Thus, parasitic parameters for each lamp vary. The parasitic parameters (e.g., parasitic reactance or parasitic capacitance) of the lamps sometimes vary significantly in a typical lamp layout. Differences in parasitic capacitance result in different capacitive leakage current for each lamp at high frequency and high voltage operating conditions, which is a variable in the effective lamp current (and thus brightness) for each lamp.

One approach is to connect primary windings of transformers in series and to connect lamps across respective secondary windings of the transformers. Since the current flowing through the primary windings is substantially equal in such a configuration, the current through the secondary windings can be controlled by the ampere-turns balancing mechanism. In such a way, the secondary currents (or lamp currents) can be controlled by a common primary current regulator and the transformer turns ratios.

A limitation of the above approach occurs when the number of lamps, and consequently the number of transformers, increases. The input voltage is limited, thereby reducing the voltage available for each transformer primary winding as the number of lamps increases. The design of the associated transformers becomes difficult.

SUMMARY OF THE INVENTION

The present invention proposes a backlighting system for driving multiple fluorescent lamps, e.g., cold cathode fluorescent lamps (CCFLs) with accurate current matching. For example, when multiple loads in a parallel configuration are powered by a common alternating current (AC) source, the current flowing through each individual load can be controlled to be substantially equal or a predetermined ratio by inserting a plurality of balancing transformers in a ring balancer configuration between the common AC source and the multiple loads. The balancing transformers include respective primary windings individually connected in series with each load. Secondary windings of the balancing transformers are connected in series and in phase to form a short circuit loop. The secondary windings conduct a common current (e.g., a short circuit current). The currents conducted by the primary windings of the respective balancing transformers, and the currents flowing through the corresponding loads, are forced to be equal by using identical turns ratio for the transformers, or to be a pre-determined ratio by using different turns ratio.

The current matching (or current sharing) in the ring balancer is facilitated by the electro-magnetic balancing mechanism of the balancing transformers and the electro-magnetic cross coupling through the ring of secondary windings. The current sharing among multiple loads (e.g., lamps) is advantageously controlled with a simple passive structure without employing additional active control mechanism, reducing complexity and cost of the backlighting system. Unlike a conventional balun approach which becomes rather complicated and sometimes impractical when the number of loads increases, the above approach is simpler, less costly, easier to manufacture, and can balance the current of many more, theoretically unlimited number of, loads.

In one embodiment, a backlighting system uses a common AC source (e.g., a single AC source or a plurality of synchronized AC sources) to drive multiple parallel lamp structures with a ring balancer comprising a network of transformers with at least one transformer designated for each lamp structure. The primary winding of each transformer in the ring balancer is connected in series with its designated lamp structure, and multiple primary winding-lamp structure combinations are coupled in parallel across a single AC source or arranged in multiple parallel subgroups for connection to a set of synchronized AC sources. The secondary windings of the transformers are connected together in series to form a closed loop. The connection polarity in the transformer network is arranged in such a way that the voltages across each secondary winding are in phase in the closed loop when the voltage applied to the primary windings are in the same phase. Thus, a common short circuit current will flow through secondary windings in the series-connected loop when in-phase voltages are developed across the primary windings.

Lamp currents flow through the respective primary windings of the transformers and through the respective lamp structures to provide illumination. The lamp currents flowing through the respective primary windings are proportional to the common current flowing through the secondary windings if the magnetizing current is neglected. Thus, the lamp currents of different lamp structures can be substantially the same as or proportional to each other depending on the transformer turns ratios. In one embodiment, the transformers have substantially the same turns ratio to realize substantially matching lamp current levels for uniform brightness of the lamps.

In one embodiment, the primary windings of the transformers in the ring balancer are connected between high voltage terminals of the respective lamp structures and the common AC source. In another embodiment, the primary windings are connected between the return terminals of the respective lamp structures and the common AC source. In yet another embodiment, separate ring balancers are employed at both ends of the lamp structures. In a further embodiment, each of the lamp structures include two or more fluorescent lamps connected in series and the primary winding associated with each lamp structure is inserted between the fluorescent lamps.

In one embodiment, the common AC source is an inverter with a controller, a switching network and an output transformer stage. The output transformer stage can include a transformer with a secondary winding referenced to ground to drive the lamp structures in a single-ended configuration. Alternately, the output transformer stage can be configured to drive the lamp structures in floating or differential configurations.

In one embodiment, the backlight system further includes a fault detection circuit to detect open lamp or shorted lamp conditions by monitoring the voltage across the secondary windings in the ring balancer. For example, when a lamp structure has an open lamp, the voltages across the corresponding serially connected primary winding and associated secondary winding rises. When a lamp structure has a shorted lamp, the voltages across the primary windings and associated secondary windings of operating (or non-shorted) lamp structures rise. In one embodiment, the backlight system shuts down the common AC source when the fault detection circuit indicates an open lamp or shorted lamp condition.

In one embodiment, the ring balancer includes a plurality of balancing transformers. Each of the balancing transformers includes a magnetic core, a primary winding, and a secondary winding. In one embodiment, the magnetic core has high relative permeability with an initial relative permeability greater than 5,000.

The plurality of balancing transformers can have substantially identical turns ratios or different turns ratios for current control among the primary windings. In one embodiment, the magnetic core has a toroidal shape, and the primary winding and the secondary winding are wound progressively on separate sections of the magnetic core. In another embodiment, a single insulated wire goes through inner holes of toroidal shape magnetic cores in the ring balancer to form a closed loop of secondary windings. In yet another embodiment, the magnetic core is based on an E shaped structure with primary winding and secondary winding wound on separate sections of a bobbin.

These and other objects and advantages of the present invention will become more fully apparent from the following description taken in conjunction with the accompanying drawings. For purpose of summarizing the invention, certain aspects, advantages and novel features of the invention have been described herein. It is to be understood that not necessarily all such advantages may be achieved in accordance with any particular embodiment of the invention. Thus, the invention may be embodied or carried out in a manner that achieves or optimizes one advantage or group of advantages as taught herein without necessarily achieving other advantages as may be taught or suggested herein.

DETAILED DESCRIPTION OF THE INVENTION

Figure 1:
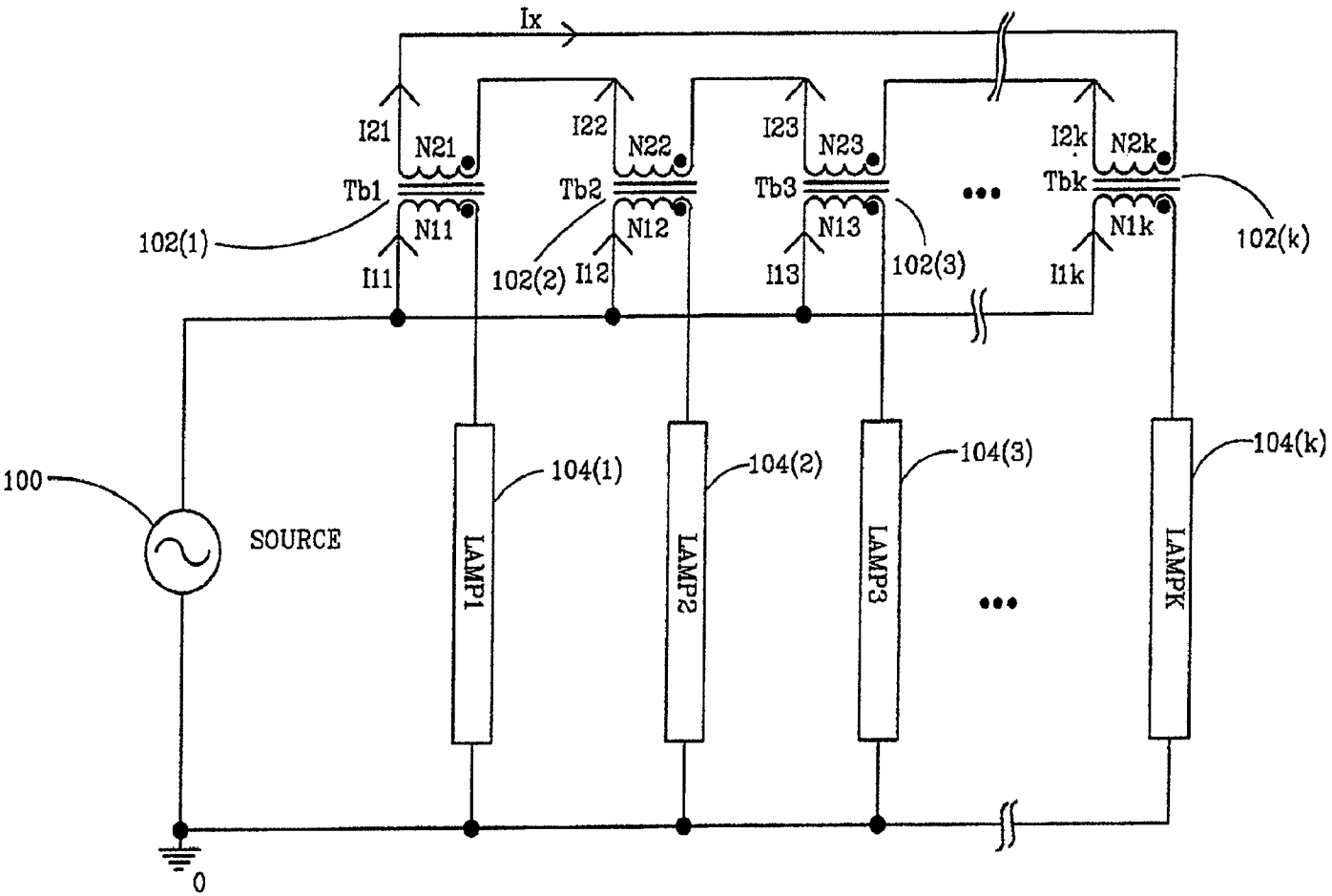
FIG. 1 is a schematic diagram of one embodiment of a backlight system with a ring balancer coupled between a source and high voltage terminals of multiple lamps.

Embodiments of the present invention will be described hereinafter with reference to the drawings. FIG. 1 is a schematic diagram of one embodiment of a backlight system with a ring balancer coupled between an input AC source 100 and high voltage terminals of multiple lamps (LAMP1, LAMP2, . . . LAMPK) shown as lamps 104(1)-104(*k*) (collectively the lamps 104). In one embodiment, the ring balancer comprises multiple balancing transformers (Tb1, Tb2, . . . Tbk) shown as balancing transformers 102(1)-102(*k*) (collectively the balancing transformers 102). Each of the balancing transformers 102 is designated for a different one of the lamps 104.

The balancing transformers 102 have respective primary windings coupled in series with their designated lamps 104. The balancing transformers 102 have respective secondary windings connected in series with each other and in phase to form a short circuit (or closed) loop. The polarity of the secondary windings is aligned so that the voltages induced in the secondary windings are in phase and add up together in the closed loop.

The primary winding-lamp combinations are coupled in parallel to the input AC source 100. The input AC source 100 is shown as a single voltage source in FIG. 1, and the primary windings are coupled between the high voltage terminals of the respective lamps 104 and the positive node of the input AC source 100. In other embodiments (not shown), the primary winding-lamp combinations are divided into subgroups with each subgroup comprising one or more parallel primary winding-lamp combinations. The subgroups can be driven by different voltage sources which are synchronized with each other.

With the above-described arrangement, a short circuit (or common) current (Ix) is developed in the secondary windings of the balancing transformers 102 when currents flow in the respective primary windings. Since the secondary windings are serially connected in a loop, the current circulating in each of the secondary winding is substantially equal. If the magnetizing currents of the balancing transformers 102 are neglected, the following relationship can be established for each of the balancing transformers 102:

$$N_{11}\cdot I_{11}=N_{21}\cdot I_{21};\ N_{12}\cdot I_{12}=N_{22}\cdot I_{22};\ \ldots\ N_{1k}\cdot I_{1k}=N_{2k}\cdot I_{2k}. \quad \text{(Eqn. 1)}$$

$N_{1k}$ and $I_{1k}$ denote the primary turns and primary current respectively of the Kth balancing transformer. $N_{2k}$ and $I_{2k}$ denote the secondary turns and secondary current respectively of the Kth balancing transformer. Thus it results:

$$I_{11}=(N_{21}/N_{11})\cdot I_{21};\ I_{12}=(N_{22}/N_{12})\cdot I_{22};\ \ldots\ I_{1k}=(N_{2k}/N_{1k})\cdot I_{2k}. \quad \text{(Eqn. 2)}$$

Since the secondary current is equalized with the serial connection of secondary windings:

$$I_{21}=I_{22}=\ldots=I_{2k}=Ix. \quad \text{(Eqn. 3)}$$

The primary currents and hence the lamp currents conducted by the respective lamps 104, can be controlled proportionally with the turns ratio $N_{21}/N_{11}$, $N_{22}/N_{12}$, . . . $N_{2k}/N_{1k}$) of the balancing transformers 102 according to Eqn. 2. Physically, if any current in a particular balancing transformer deviates from the relationships defined in Eqn. 2, the resulting magnetic flux from the error ampere turns will induce a corresponding correction voltage in the primary winding to force the primary current to follow the balancing condition of Eqn. 2.

With the above described relationship, if equal lamp current is desired, it can be realized by setting substantially identical turns ratio for the balancing transformers 102 regardless of possible variations in the lamp operating voltage. Further, if the current of a particular lamp needs to be set at a different level from other lamps due to some practical reasons, such as differences in parasitic capacitance due to surrounding environment, it can be achieved by adjusting the turns ratio of the corresponding balancing transformer according to Eqn. 2. In this way the current of each lamp can be adjusted without using any active current sharing scheme or using a complicated balun structure. In addition to the above advantages, the proposed backlighting system can reduce the short circuit current when a lamp is shorted.

Furthermore, the proposed backlighting system facilitates automatic lamp striking. When a lamp is open or unlit, additional voltage across its designated primary winding, in phase with the input AC source 100, will be developed to help to strike the lamp. The additional voltage is generated by a flux increase due to the decrease in primary current. For example, when a particular lamp is not ignited, the lamp is effectively an open circuit condition. The current flowing in the corresponding primary winding of the balancing transformer is substantially zero. Because of the circulating current in the closed loop of secondary windings, the ampere turns balancing equation of Eqn. 1 cannot be maintained in such a situation. Excessive magnetizing force resulted from the unbalanced ampere turns will generate an additional voltage in the primary winding of the balancing transformer. The additional voltage adds in phase with the input AC source 100 to result in an automatic increase of the voltage across the non-ignited lamp, thus helping the lamp to strike.

It should be noted that the application of this invention is not limited to multiple lamps (e.g., CCFLs) in backlight systems. It also applies to other types of applications and different types of loads in which multiple loads are connected to a common AC source in parallel and current matching among the loads is desired.

It should also be noted that various circuit configurations can be realized with this invention in addition to the embodiment shown in FIG. 1. FIGS. 2-7 show examples of other embodiments of backlight systems using at least one ring balancer for current matching. In practical applications other types of configurations (not shown) can also be formulated based on the same concept, depending on the actual backlight system construction. For instance, it is possible to balance the current of multiple lamps when they are driven by more than one AC sources with this concept, as long as the multiple AC sources are synchronized and maintain the phase relations according to the principle of this concept.

Figure 2:
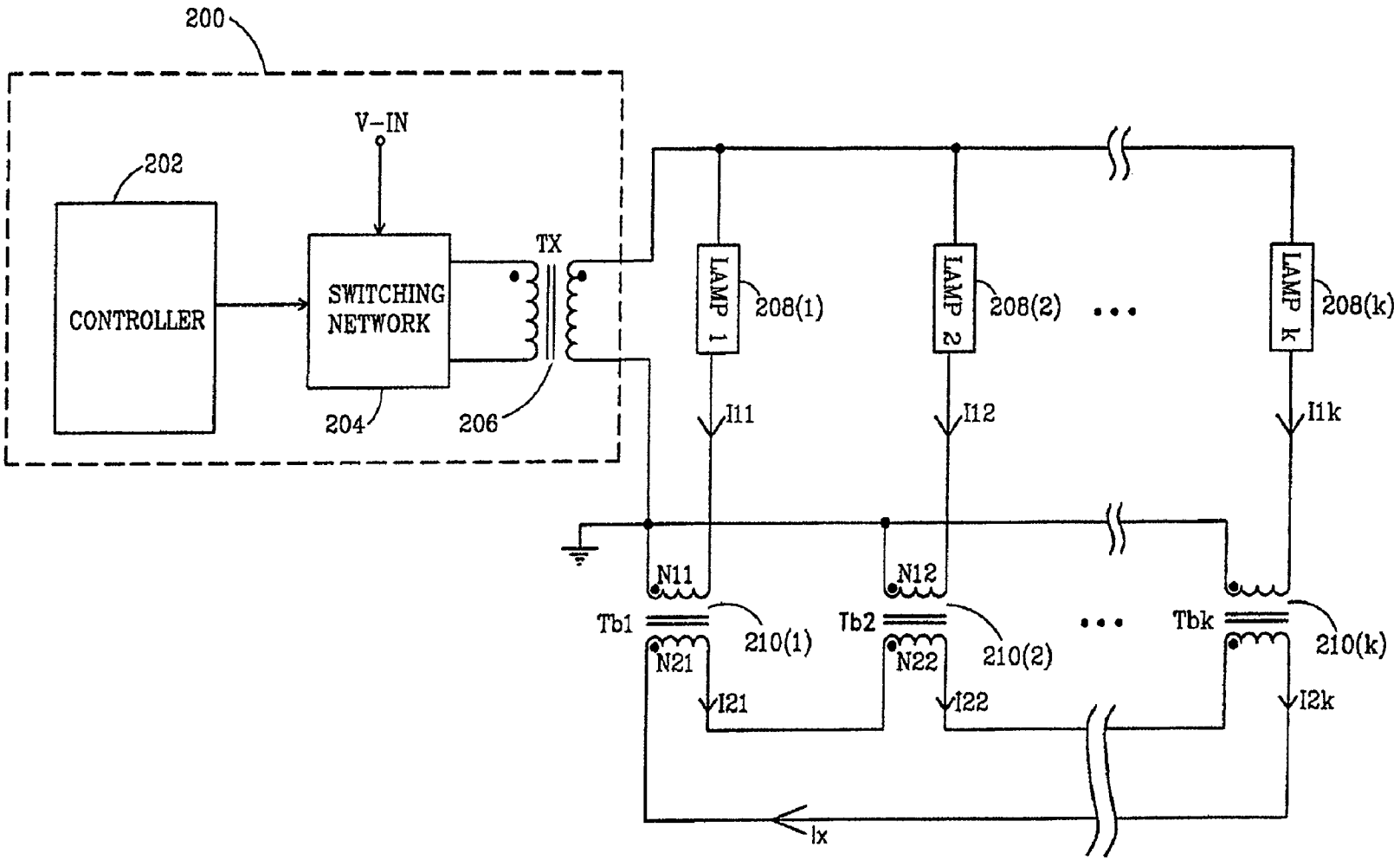
FIG. 2 is a schematic diagram of one embodiment of a backlight system with a ring balancer coupled between return terminals of multiple lamps and ground.

FIG. 2 is a schematic diagram of one embodiment of a backlight system with a ring balancer coupled between ground and return terminals of multiple lamps (LAMP 1, LAMP 2, . . . LAMP K) shown as lamps 208(1)-208(*k*) (collectively the lamps 208). In one embodiment, the ring balancer comprises multiple balancing transformers (Tb1, Tb2, . . . Tbk) shown as balancing transformers 210(1)-210(*k*) (collectively the balancing transformers 210). Each of the balancing transformers 210 is designated for a different one of the lamps 208.

The balancing transformers 210 have respective primary windings coupled in series with their designated lamps 208 and respective secondary windings connected in a serial ring. The embodiment shown in FIG. 2 is substantially similar to the embodiment shown in FIG. 1 except the ring balancer is coupled to return sides of the respective lamps 208. For example, the primary windings are coupled between the respective return terminals of the lamps 208 and ground. The high voltage terminals of the lamps 208 are coupled to a positive terminal of a voltage source 200.

By way of example, the voltage source 200 is shown in further detail as an inverter comprising a controller 202, a switching network 204 and an output transformer stage 206. The switching network 204 accepts a direct current (DC) input voltage (V-IN) and is controlled by driving signals from the controller 202 to generate an AC signal for the output transformer stage 206. In the embodiment shown in FIG. 2, the output transformer stage 206 includes a single transformer with a secondary winding referenced to ground to drive the lamps 208 and ring balancer in a single-ended configuration.

As described above in connection with FIG. 1, the ring balancer facilitates automatic increase of the voltage across a non-stricken lamp to guarantee reliable striking of lamps in backlight systems without additional components or mechanism. Lamp striking is one of the difficult problems in the operation of multiple lamps in a parallel configuration. With automatic lamp striking, the headroom typically reserved for striking operations in an inverter design can be reduced to achieve better efficiency of the inverter and lower crest factor of the lamp current through better optimization of transformer design in the output transformer stage 206, better utilization of switching duty cycle by the controller 202, lower transformer voltage stress, etc.

Figure 3:
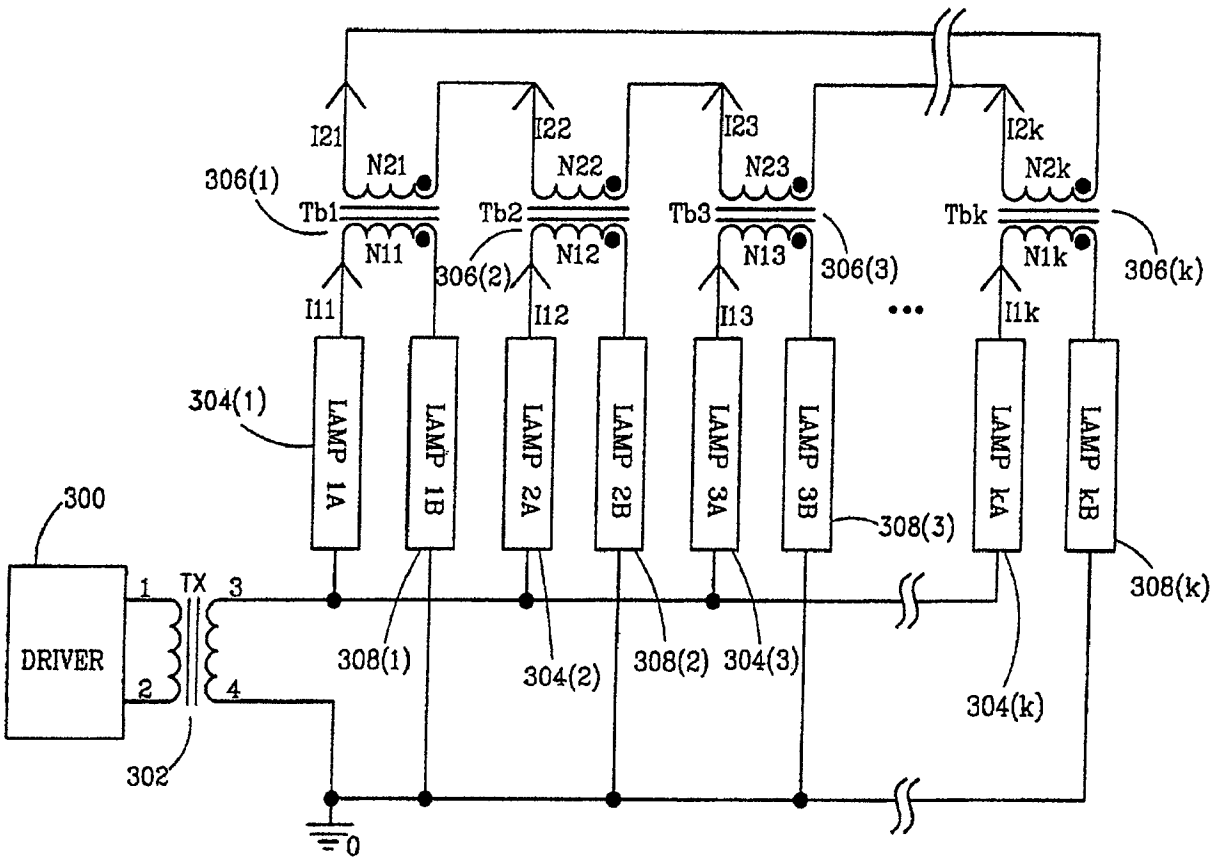
FIG. 3 is a schematic diagram of one embodiment of a backlight system with multiple pairs of lamps in a parallel configuration and a ring balancer inserted between the pairs of lamps.

FIG. 3 is a schematic diagram of one embodiment of a backlight system with multiple pairs of lamps in a parallel configuration and a ring balancer inserted between the pairs of lamps. For example, a first group of lamps (LAMP 1A, LAMP 2A, . . . LAMP kA) shown as lamps 304(1)-304(*k*)

(collectively the first group of lamps 304) are coupled between a high voltage terminal of an output transformer (TX) 302 and the ring balancer. A second group of lamps (LAMP 1B, LAMP 2B, . . . LAMP kB) shown as lamps 308(1)-308(*k*) (collectively the second group of lamps 308) are coupled between the ring balancer and a return terminal (or ground). A driver circuit 300 drives the output transformer 302 to provide an AC source for powering the first and second groups of lamps 304, 308.

In one embodiment, the ring balancer comprises a plurality of balancing transformers (Tb1, Tb2, . . . Tbk) shown as balancing transformers 306(1)-306(*k*) (collectively the balancing transformers 306). Each of the balancing transformers 306 is designated for a pair of lamps, one lamp from the first group of lamps 304 and one lamp from the second group of lamps 308. The balancing transformers 306 have respective secondary windings serially connected in a closed loop. In this configuration, the number of balancing transformers is advantageously half the number of lamps to be balanced.

For example, the balancing transformers 306 have respective primary windings inserted in series between their designated pairs of lamps. The first group of lamps 304 and the second group of lamps 308 are effectively coupled in series by pairs with a different primary winding inserted between each pair. The pairs of lamps with respective designated primary windings are coupled in parallel across the output transformer 302.

Figure 4:
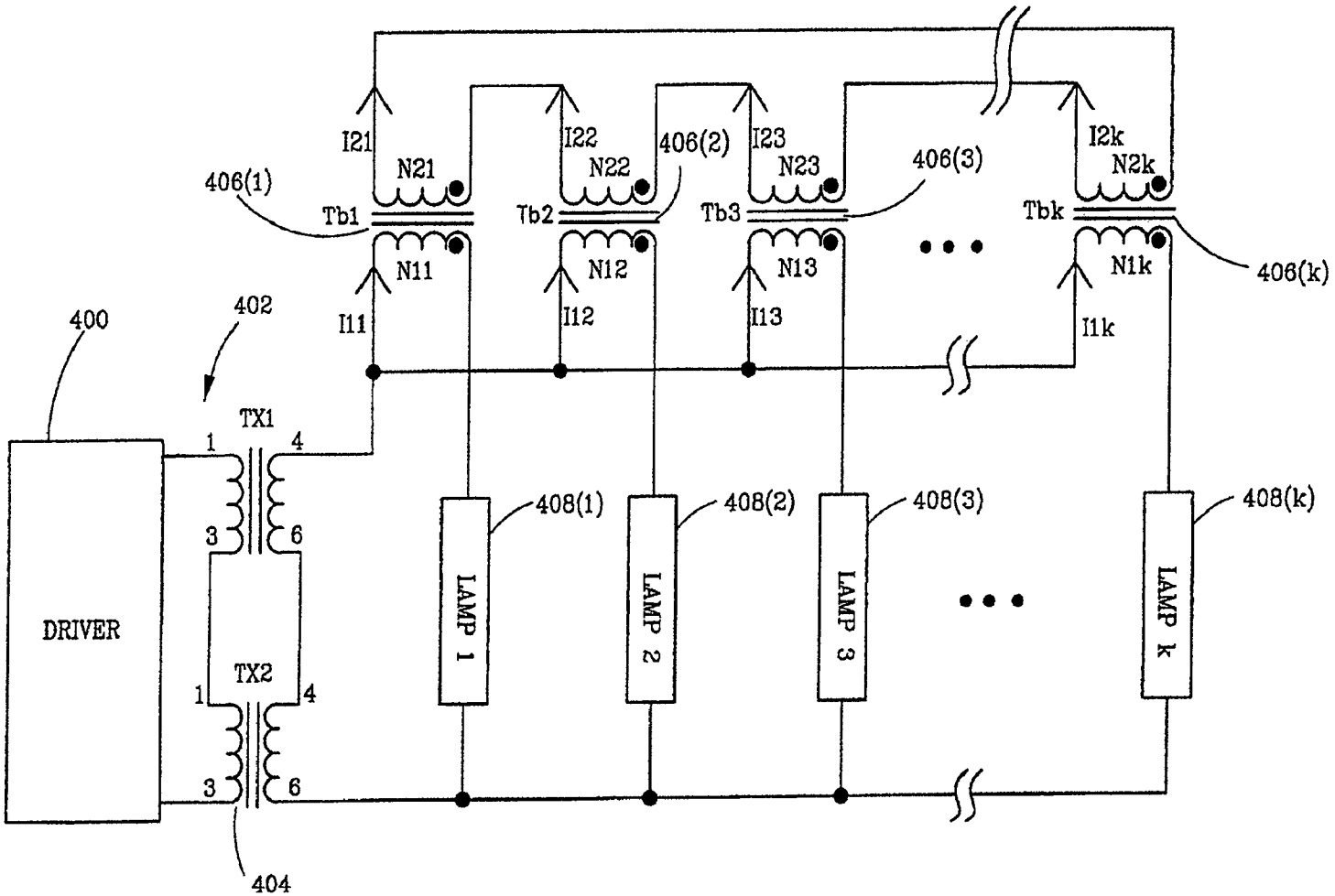
FIG. 4 is a schematic diagram of one embodiment of a backlight system with multiple lamps driven in a floating configuration.

FIG. 4 is a schematic diagram of one embodiment of a backlight system with multiple lamps driven in a floating configuration. For example, a driver circuit 400 drives an output transformer stage comprising of two transformers 402, 404 with respective primary windings connected in series and respective secondary windings connected in series. The serially connected secondary windings of the output transformers 402, 404 are coupled across a ring balancer and a group of lamps (LAMP 1, LAMP 2, . . . LAMP k) shown as lamps 408(1)-408(*k*) (collectively the lamp 408).

In one embodiment, the ring balancer comprises a plurality of balancing transformers (Tb1, Tb2, . . . Tbk) shown as balancing transformers 406(1)-406(*k*) (collectively the balancing transformers 406). Each of the balancing transformers 406 is dedicated to a different one of the lamps 408. The balancing transformers 406 have respective primary windings connected in series with their dedicated lamps 408 and respective secondary windings connected in series with each other in a closed loop. The primary winding-lamp combinations are coupled in parallel across the serially connected secondary windings of the output transformers 402, 404. The lamps 408 are driven in a floating configuration without reference to a ground terminal.

Figure 5:
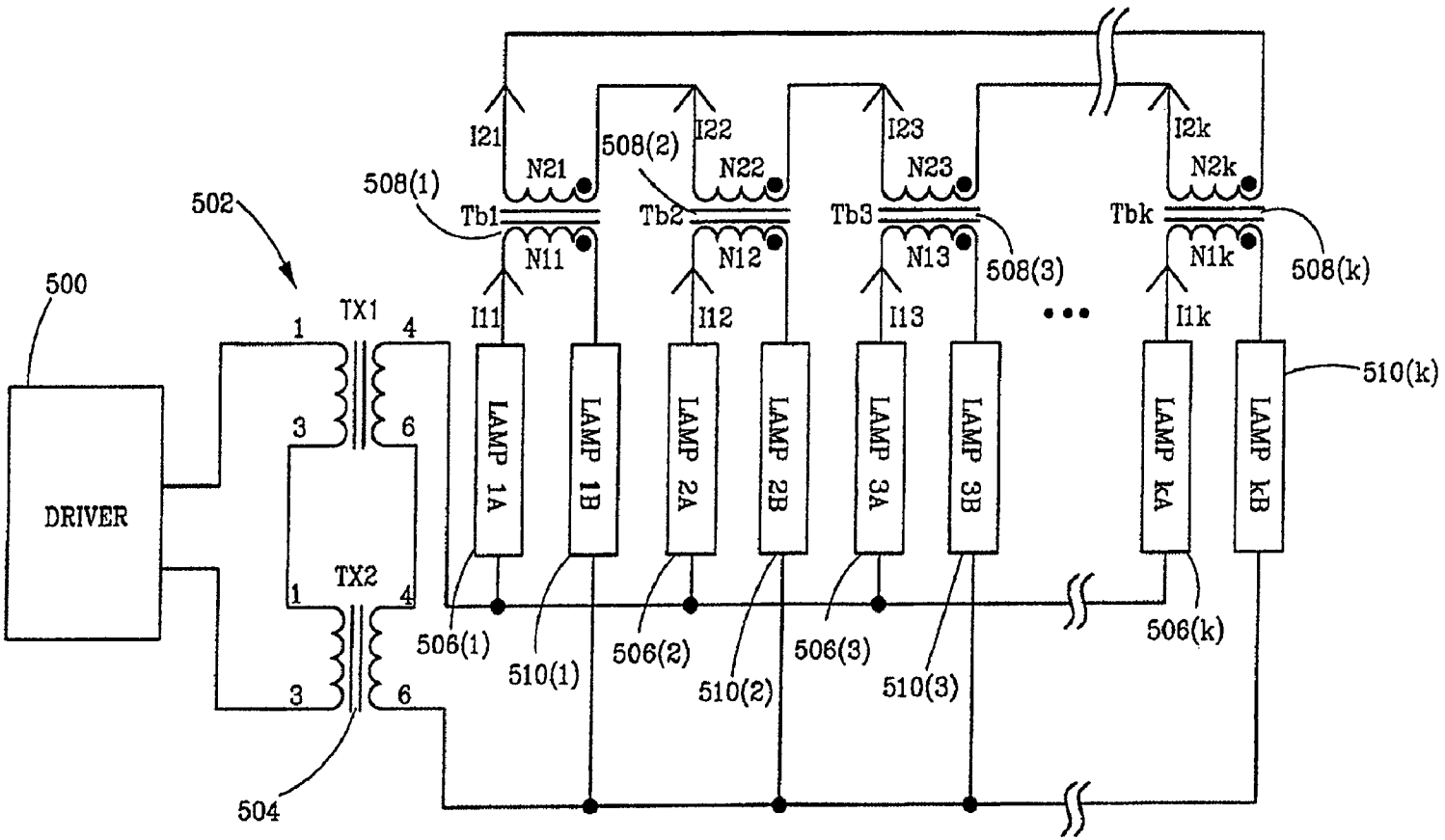
FIG. 5 is a schematic diagram of another embodiment of a backlight system with multiple lamps driven in a floating configuration.

FIG. 5 is a schematic diagram of another embodiment of a backlight system with multiple lamps driven in a floating configuration. FIG. 5 illustrates a selective combination of FIGS. 3 and 4. Similar to FIG. 3, a ring balancer is inserted between multiple pairs of serial lamps connected in parallel across a common source. Similar to FIG. 4, the common source includes a driver circuit 500 coupled to an output transformer stage comprising of two serially connected transformers 502, 504.

For example, a first group of lamps (LAMP 1A, LAMP 2A, . . . LAMP kA) shown as lamps 506(1)-506(*k*) (collectively the first group of lamps 506) are coupled between a first terminal the output transformer stage and the ring balancer. A second group of lamps (LAMP 1B, LAMP 2B, . . . LAMP kB) shown as lamps 510(1)-510(*k*) (collectively the second group of lamps 510) are coupled between the ring balancer and a second terminal of the output transformer stage. The ring balancer comprises a plurality of balancing transformers (Tb1, Tb2, . . . Tbk) shown as balancing transformers 508(1)-508(*k*) (collectively the balancing transformers 508). Each of the balancing transformers 508 is designated for a pair of lamps, one lamp from the first group of lamps 506 and one lamp from the second group of lamps 510.

The balancing transformers 508 have respective primary windings inserted in series between their designated pairs of lamps. The first group of lamps 506 and the second group of lamps 510 are effectively coupled in series by pairs with a different primary winding inserted between each pair. The pairs of lamps with respective designated primary windings are coupled in parallel across the serially connected secondary windings of the transformers 502, 504 in the output transformer stage. The balancing transformers 508 have respective secondary windings serially connected in a closed loop. As discussed above, the number of balancing transformers 508 is advantageously half the number of lamps 506, 510 to be balanced in this configuration.

Figure 6:
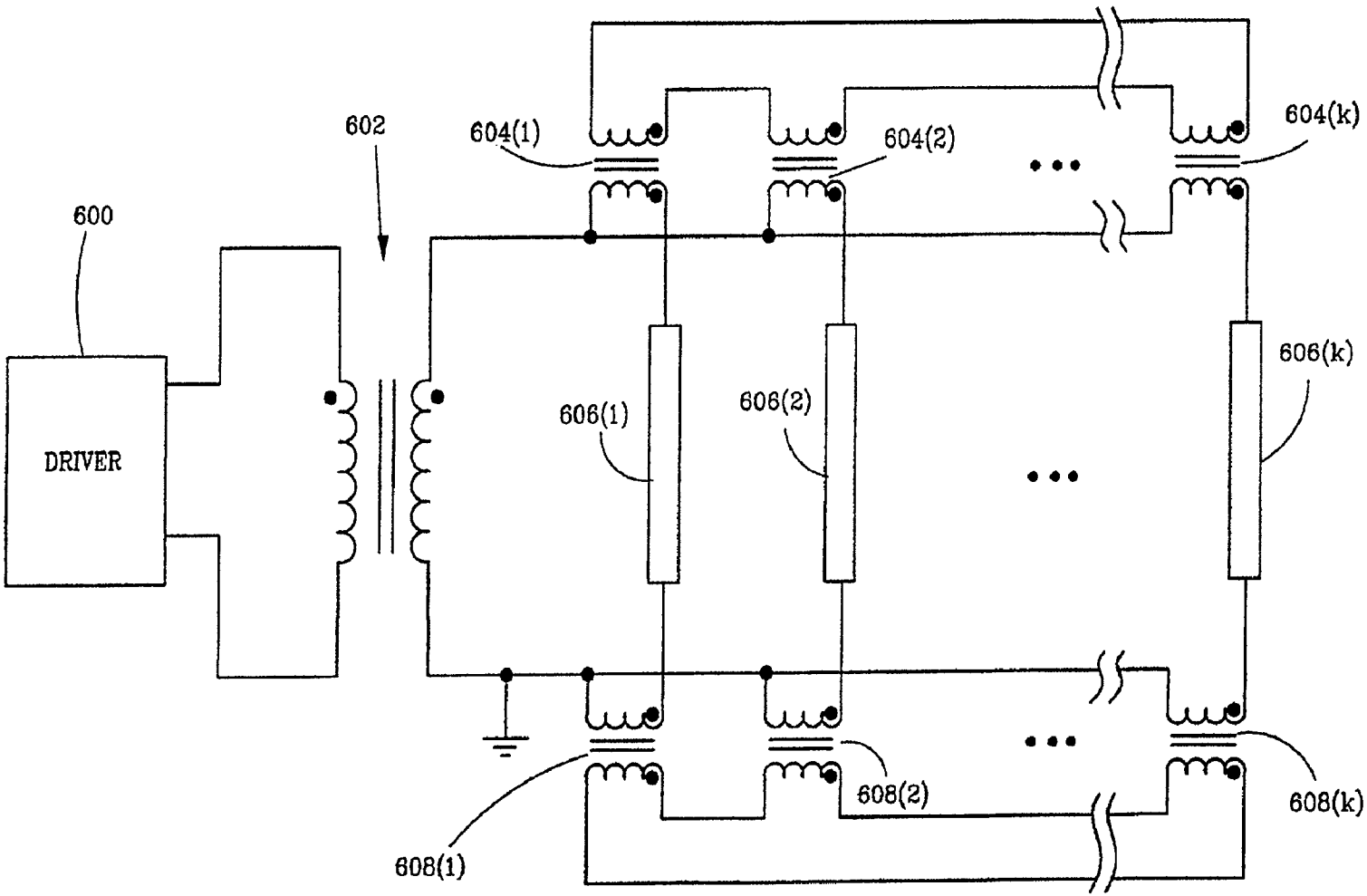
FIG. 6 is a schematic diagram of one embodiment of a backlight system with two ring balancers, one at each end of parallel lamps.

FIG. 6 is a schematic diagram of one embodiment of a backlight system with two ring balancers, one at each end of parallel lamps shown as lamps 606(1)-606(*k*) (collectively the lamps 606). The first ring balancer comprises a first plurality of balancing transformers shown as balancing transformers 604(1)-604(*k*) (collectively the first set of balancing transformers 604). Secondary windings in the first set of balancing transformers 604 are serially coupled together in a first closed ring. The second ring balancer comprises a second plurality of balancing transformers shown as balancing transformers 608(1)-608(*k*) (collectively the second set of balancing transformers 608). Secondary windings in the second set of balancing transformers 608 are serially coupled together in a second closed ring.

Each of the lamps 606 is associated with two different balancing transformers, one from the first set of balancing transformers 604 and one from the second set of balancing transformers 608. Thus, primary windings in the first set of balancing transformers 604 are coupled in series with their associated lamps 606 and corresponding primary windings in the second set of balancing transformers 608. The serial combinations of lamp with different primary windings on both ends are coupled in parallel across a common source. In FIG. 6, the common source (e.g., an inverter) is shown as a driver 600 coupled to an output transformer 602. The output transformer 602 may drive the lamps 606 and ring balancers in a floating configuration or have a secondary winding with one terminal connected to ground as shown in FIG. 6.

Figure 7:
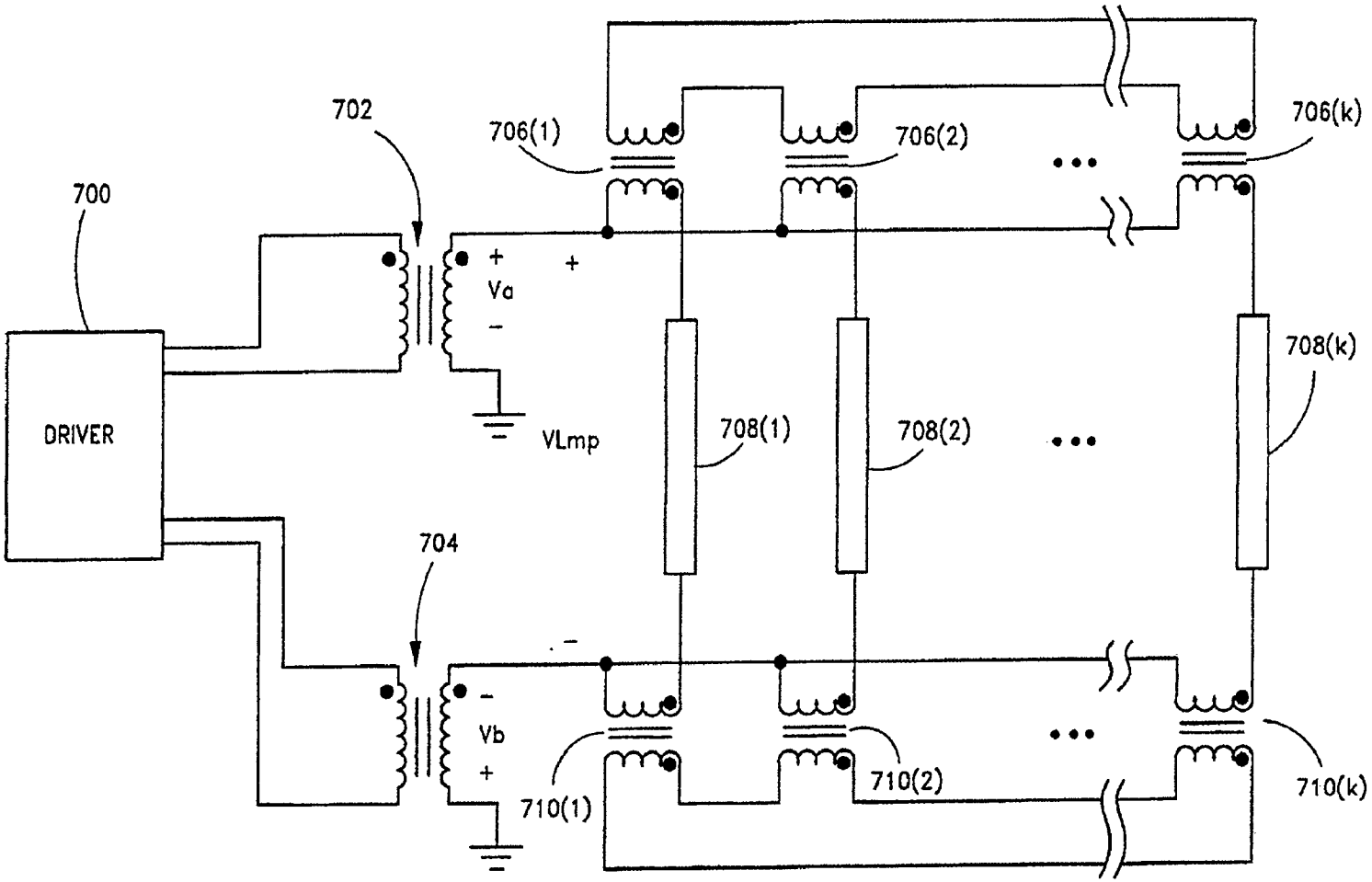
FIG. 7 is a schematic diagram of one embodiment of a backlight system with multiple lamps driven in a differential configuration.

FIG. 7 is a schematic diagram of one embodiment of a backlight system with multiple lamps driven in a differential configuration. As an example, the embodiment includes two ring balancers coupled on respective ends of a plurality of lamps shown as lamps 708(1)-708(*k*) (collectively the lamps 708). The connections between the ring balancers and the lamps 708 are substantially similar to corresponding connections shown in FIG. 6.

The first ring balancer includes a plurality of balancing transformers shown as balancing transformers 706(1)-706(*k*) (collectively the first group of balancing transformers 706). The first group of balancing transformers 706 has respective secondary windings coupled in a closed loop to balance currents among the lamps 708. The second ring balancer includes a plurality of balancing transformers shown as balancing transformers 710(1)-710(*k*) (collectively the second group of balancing transformers 710). The second group of balancing transformers 710 has respective secondary windings coupled in another closed loop to reinforce or provide redundancy in balancing currents among the lamps 708.

Each of the lamps 708 is associated with two different balancing transformers, one from the first group of balancing transformers 706 and one from the second group of balancing transformers 710. Primary windings in the first group of balancing transformers 706 are coupled in series with their associated lamps 708 and corresponding primary windings in the second group of balancing transformers 710. The serial combinations of lamp with different primary windings on both ends are coupled in parallel across a common source.

In FIG. 7, the common source (e.g., a split phase inverter) is shown as a driver 700 coupled to a pair of output transformers 702, 704 which are driven by phase-shifted signals or signals with other switching patterns to produce differential signals (Va, Vb) across secondary windings of the respective output transformers 702, 704. The differential signals combine to generate an AC lamp voltage (VImp=Va+Vb) across lamps 708 and ring balancers. Further details on the split phase inverter are discussed in Applicant's copending U.S. patent application Ser. No. 10/903,636, filed on Jul. 30, 2004, and entitled "Split Phase Inverters for CCFL Backlight System," the entirety of which is incorporated herein by reference.

Figure 8:
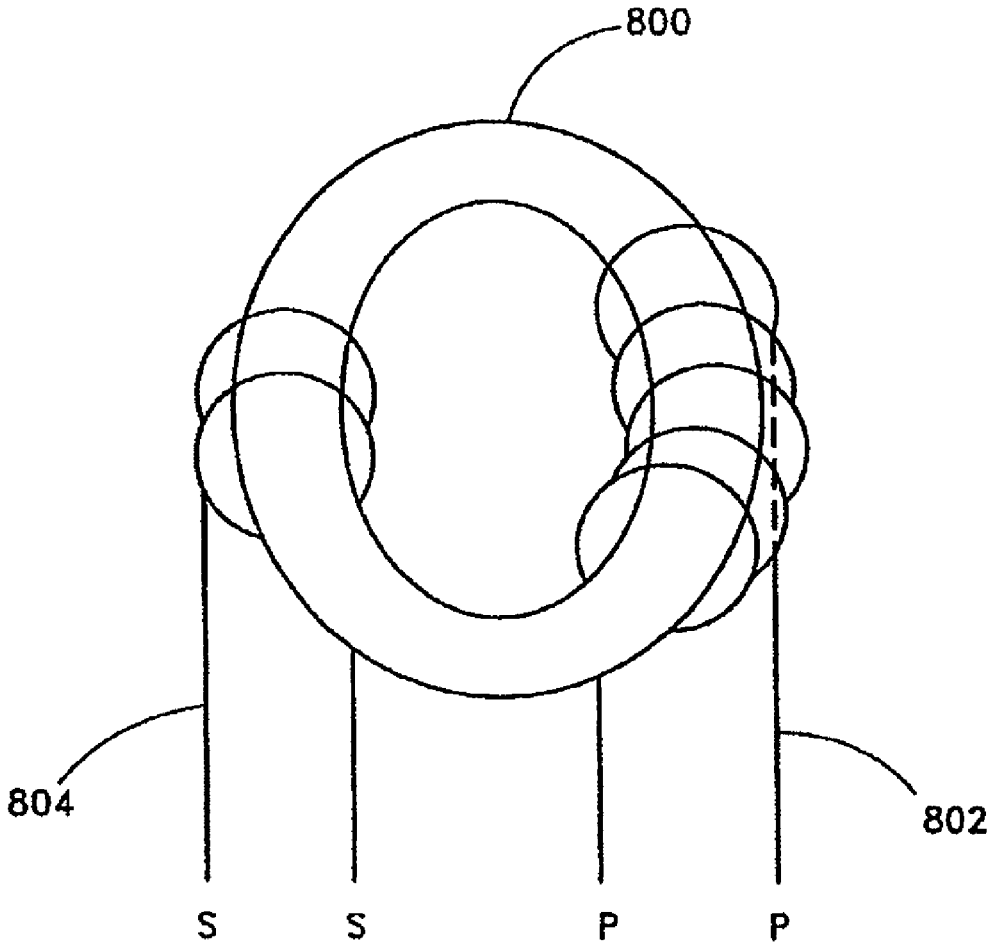
FIG. 8 illustrates one embodiment of a toroidal core balancing transformer in accordance with the present invention.

FIG. 8 illustrates one embodiment of a toroidal core balancing transformer in accordance with the present invention. A primary winding 802 and a secondary winding 804 are directly wound on the toroidal core 800. In one embodiment, the primary winding 802 on the toroidal core 800 is wound progressively, instead of in overlapped multiple layers, to avoid high potential between primary turns. The secondary winding 804 can be likewise wound progressively.

The wire gauge for the windings 802, 804 should be selected based on the current rating, which can be derived from Eqn. 1 and Eqn. 2. The balancing transformers in a ring balancer advantageously work with any number of secondary turns or primary-to-secondary turns ratios. A good balancing result can be obtained with different turns ratios according to the relationship established in Eqn. 1 and Eqn. 2. In one embodiment, a relatively small number of turns (e.g., 1-10 turns) is chosen for the secondary winding 804 to simplify the winding process and to lower the manufacturing cost. Another factor to determine the desired number of secondary turns is the desired voltage signal level across the secondary winding 804 for a fault detection circuit, which is discussed in further detail below.

Figure 9:
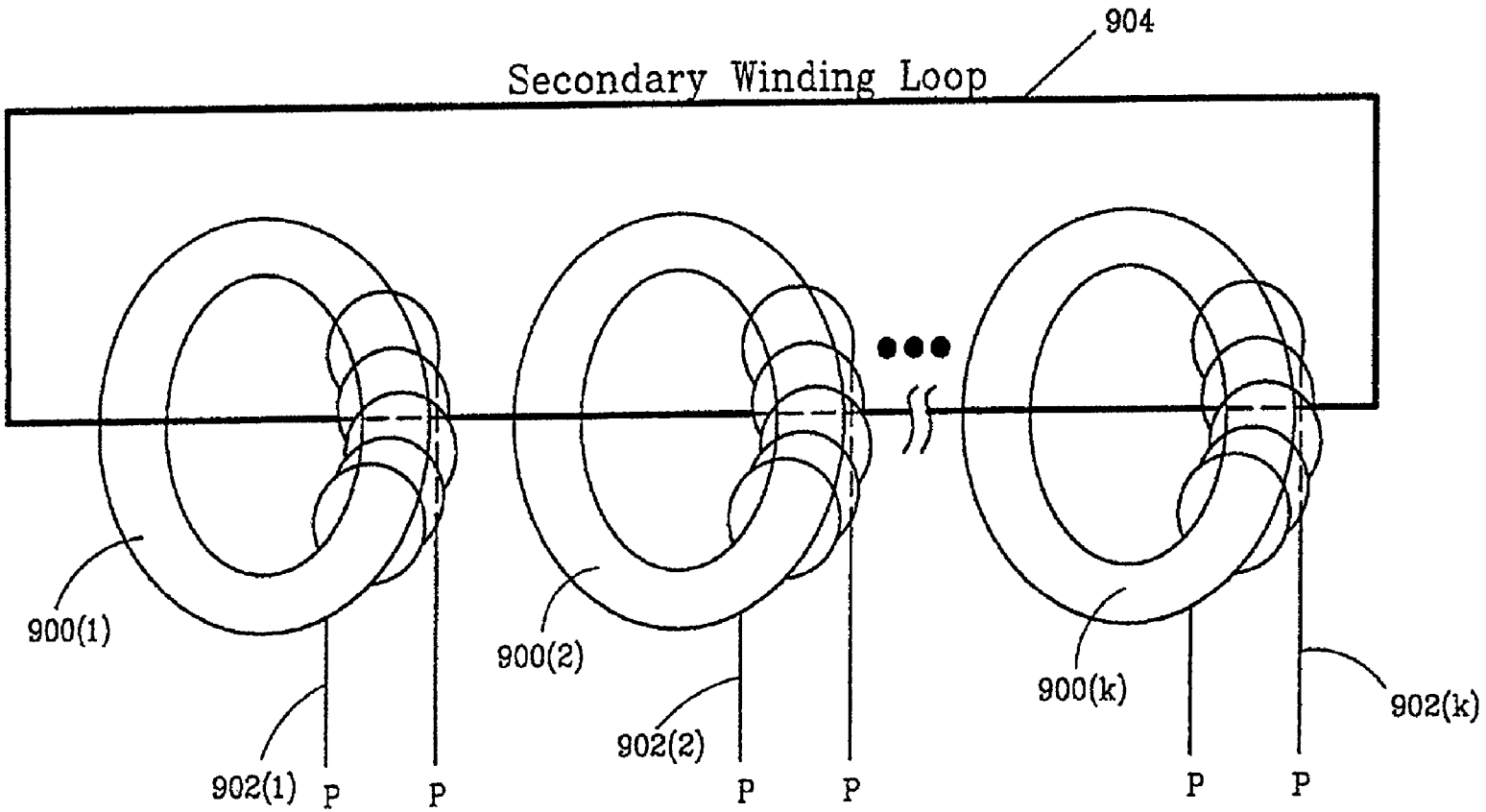
FIG. 9 is one embodiment of a ring balancer with a single turn secondary winding loop.

FIG. 9 is one embodiment of a ring balancer with a single turn secondary winding loop 904. The ring balancer comprises a plurality of balancing transformers using toroidal cores shown as toroidal cores 900(1)-900(*k*) (collective the toroidal cores 900). Primary windings shown as primary windings 902(1)-902(*k*) (collectively the primary windings 902) are progressively wound on the respective toroidal cores 900. A single insulated wire goes through the inner holes of the toroidal cores to 900 form a single turn secondary winding loop 904.

Figure 10:
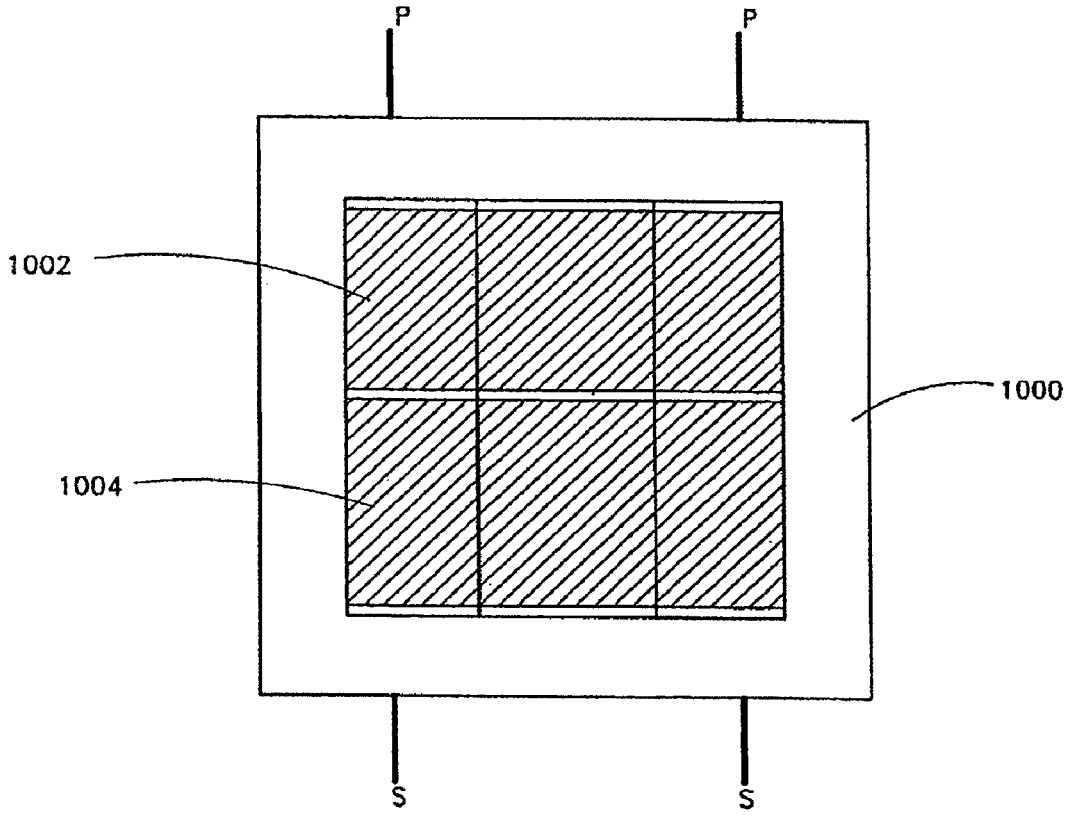
FIG. 10 is one embodiment of a balancing transformer using an E-core based structure.

FIG. 10 is one embodiment of a balancing transformer using an E-core based structure 1000. A winding bobbin is used. The bobbin is divided into two sections with a first section 1002 for the primary winding and a second section 1004 for the secondary winding. One advantage of such a winding arrangement is better insulation between the primary and secondary windings because a high voltage (e.g., a few hundred volts) can be induced in the primary windings during striking or open lamp conditions. Another advantage is reduced cost due to a simpler manufacturing process.

An alternative embodiment of the balancing transformer (not shown) overlaps the primary winding with the secondary winding to provide tight coupling between the primary and secondary windings. Insulation between the primary and secondary windings, manufacturing process, etc. becomes more complex with overlapping primary and secondary windings.

The balancing transformers used in a ring balancer can be constructed with different types of magnetic cores and winding configurations. In one embodiment, the balancing transformers are realized with relatively high permeability materials (e.g., materials with initial relative permeability greater than 5,000). The relatively high permeability materials provide a relatively high inductance with a given window space at the rated operating current. In order to obtain good current balancing, the magnetizing inductance of the primary winding should be as high as possible, so that during operation the magnetizing current can be small enough to be negligible.

The core loss is normally higher for relatively high permeability materials than for relatively low permeability materials at a given operating frequency and flux density. However, the working flux density of the transformer core is relatively low during normal operations of the balancing transformer because the magnitude of the induced voltage in the primary winding, which compensates for the variations in operating lamp voltage, is relatively low. Thus, the use of relatively high permeability materials in the balancing transformer advantageously provides relatively high inductance while maintaining the operational loss of the transformer at a reasonably low level.

Figure 11:
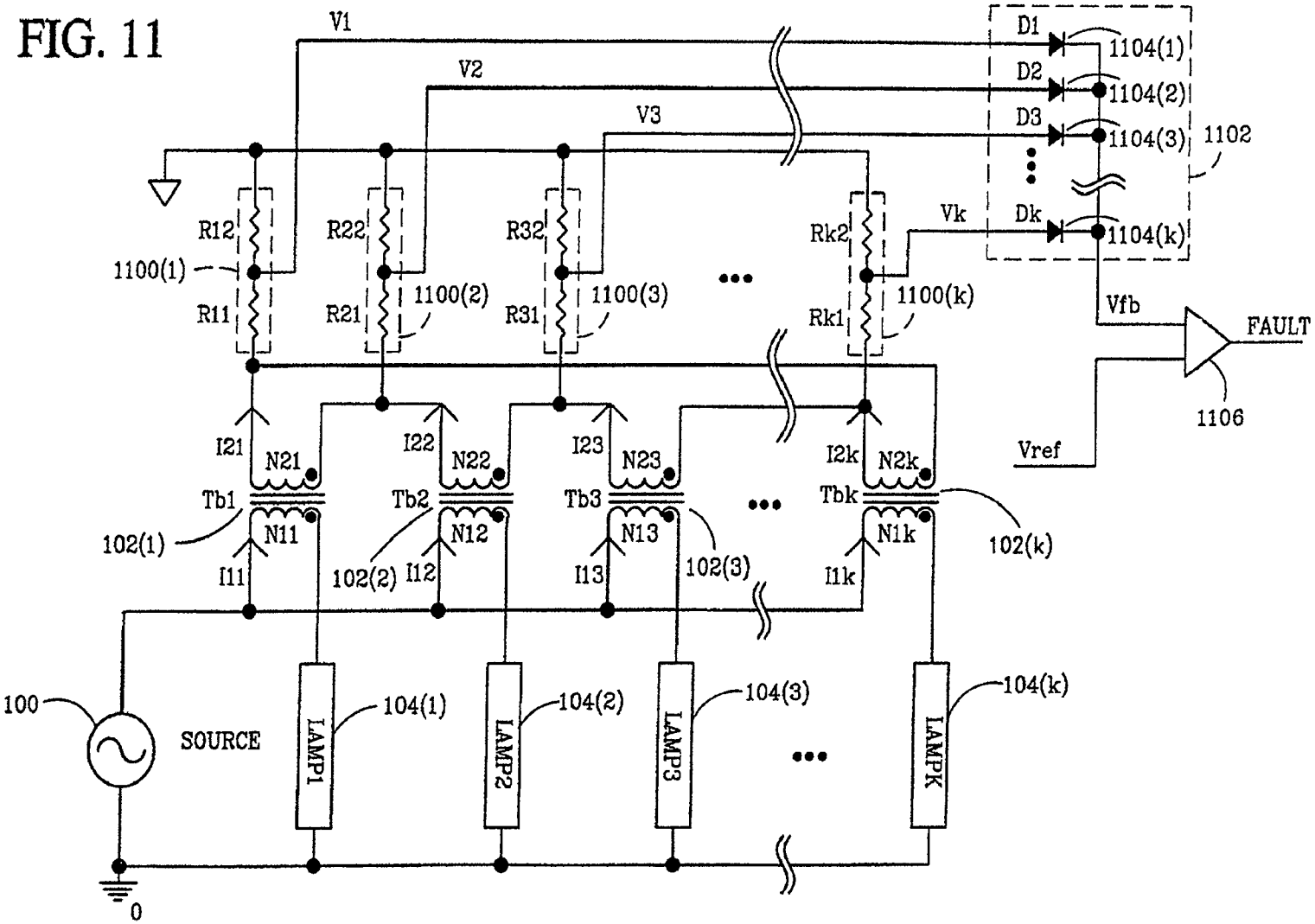
FIG. 11 illustrates one embodiment of a fault detection circuit coupled to a ring balancer to detect presence of non-operational lamps.

FIG. 11 illustrates one embodiment of a fault detection circuit coupled to a ring balancer to detect presence of non-operational lamps. The configuration of the backlight system shown in FIG. 11 is substantially similar to the one shown in FIG. 1 with multiple lamps 104, a common source 100 and the ring balancer comprising a plurality of balancing transformers 102. The backlight system in FIG. 11 further includes the fault detection circuit to monitor voltages at the secondary windings of the balancing transformers 102 to detect a non-operating lamp condition.

Lamp currents conducted by the multiple lamps 104 are balanced by connecting designated primary windings of the balancing transformers 102 in series with each lamp while secondary windings of the balancing transformers 102 are connected together in a serial loop with a predefined polarity. During normal operations, a common current circulating in each of the secondary windings forces currents in the primary windings to equalize with each other, thereby keeping the lamp currents balanced.

Any error current in a primary winding effectively generates a balancing voltage in that primary winding to compensate for tolerances in lamp operating voltages which can vary up to 20% from the nominal value. A corresponding voltage develops in the associated secondary winding and is proportional to the balancing voltage.

The voltage signal from the secondary windings of the balancing transformers 102 can be monitored to detect open lamp or shorted lamp conditions. For example, when a lamp is open, the voltages in both the primary and secondary windings of the corresponding balancing transformer 102 will rise significantly. When a short circuit occurs with a particular lamp, voltages in transformer windings associated with non-shorted lamps rise. A level detection circuit can be used to detect the rising voltage to determine the fault condition.

In one embodiment, open lamp or shorted lamp conditions can be distinctively detected by sensing voltages at the secondary windings of the balancing transformers 102 and comparing the sensed voltages to a predetermined threshold. In FIG. 11, voltages at the secondary windings are sensed with respective resistor dividers shown as resistor dividers 1100(1)-1100(*k*) (collectively the resistors dividers 1100). The resistor dividers 1100, each comprising of a pair of resistors connected in series, are coupled between predetermined terminals of the respective secondary windings and ground. The common nodes between the respective pair of resistors provide sensed voltages (V1, V2, . . . Vk) which are provided to a combining circuit 1102. In one embodiment, the combining circuit 1102 includes a plurality of isolation diodes shown as isolation diodes 1104(1)-1104(*k*) (collectively the isolation diodes 1104). The isolation diodes 1104 form a diode OR-ed circuit with anodes individually coupled to the respective sensed voltages and cathodes commonly connected to generate a feedback voltage (Vfb) corresponding to the highest sensed voltage.

In one embodiment, the feedback voltage is provided to a positive input terminal of a comparator 1106. A reference voltage (Vref) is provided to a negative input terminal of the comparator 1106. When the feedback voltage exceeds the reference voltage, the comparator 1106 outputs a fault signal (FAULT) to indicate the presence of one or more non-operating lamps. The fault signal can be used to turn off the common source powering the lamps 104.

The fault detection circuit described above advantageously has no direct connection to the lamps 104, thus reducing the complexity and cost associated with this feature. It should be noted that many different types of fault detection circuits can be designed to detect fault lamp conditions by monitoring the voltages at the secondary windings in a ring balancer.

While certain embodiments of the inventions have been described, these embodiments have been presented by way of example only, and are not intended to limit the scope of the inventions. Indeed, the novel methods and systems described herein may be embodied in a variety of other forms; furthermore, various omissions, substitutions and changes in the form of the methods and systems described herein may be made without departing from the spirit of the inventions. The accompanying claims and their equivalents are intended to cover such forms or modifications as would fall within the scope and spirit of the inventions.

What is claimed is:

1. A backlight system comprising:

a plurality of loads in a parallel configuration;

a current source for powering the plurality of loads;

a ring balancer coupled in series with the plurality of loads, wherein the ring balancer comprises a plurality of balancing transformers with respective primary windings and respective secondary windings, each of the primary windings connected in series with at least one load, the secondary windings connected in series with each other; and a fault detection circuit configured to monitor a plurality of node voltages in the secondary windings, to generate a feedback voltage corresponding to at least one of the plurality of node voltages, and to compare the feedback voltage with a reference voltage to determine a fault condition.

2. The backlight system of claim 1, wherein the load is a lamp.

3. The backlight system of claim 2, wherein the lamp is a cold cathode fluorescent lamp (CCFL).

4. The backlight system of claim 1, wherein the fault detection circuit outputs a fault signal to turn off the current source when the fault condition occurs.

5. The backlight system of claim 1, wherein the load comprises two lamps, and each of the corresponding primary windings of the ring balancer is connected between a different set of two lamps.

6. The backlight system of claim 1, wherein the plurality of balancing transformers have substantially identical turns ratios and wherein the plurality of loads conduct substantially equal currents.

7. The backlight system of claim 1, wherein the plurality of balancing transformers have different turns ratios to allow the plurality of loads to conduct currents with predetermined ratios.

8. A method to balance currents among multiple parallel branches of loads and to detect a fault condition, the method comprising:

providing a ring balancer in series with a plurality of loads, wherein the ring balancer comprises a plurality of balancing transformers with respective primary and respective secondary windings;

connecting each of the primary windings of the balancing transformers in series with at least one load;

connecting the secondary windings of the balancing transformers in series with each other such that a common current circulates in the secondary windings when at least one load is conducting current;

monitoring a plurality of node voltages in the secondary windings to detect a fault condition; and turning off a current source when the fault condition occurs.

9. The method of claim 8 further comprising generating additional voltage in the primary windings coupled in series with open loads to maintain ampere turns relationships for the respective balancing transformers while current is circulating in the secondary windings, wherein the additional voltage adds in phase with the current source.

10. The method of claim 9 further comprising controlling the current conducted by the loads of a parallel branch based on a turns ratio of a designated balancing transformer.

11. The method of claim 8, wherein the fault condition is detected when any one of the plurality of node voltages exceeds a predetermined threshold.

12. The method of claim 8, wherein the load is a lamp.

13. The method of claim 12, wherein the lamp is a cold cathode fluorescent lamp (CCFL).

14. An illumination system comprising:

a plurality of load structures in a parallel configuration;

a current source for powering the plurality of load structures;

a ring balancer coupled in series with the plurality of load structures, wherein the ring balancer comprises a plurality of balancing transformers with respective primary windings and respective secondary windings, each of the primary windings connected in series with at least one load structure, the secondary windings connected in series with each other; and a fault detection circuit configured to monitor voltages in the secondary windings.

15. The illumination system of claim 14, wherein the load structure is a lamp.

16. The illumination system of claim 15, wherein the lamp is a cold cathode fluorescent lamp (CCFL).

17. The illumination system of claim 14, wherein the load structure comprises a pair of loads.

18. The illumination system of claim 14, wherein the fault detection circuit is further configured to turn off the current source when a fault condition is detected.

19. The illumination system of claim 14, wherein current conducted by the load structure of a parallel branch is proportional to a turns ratio of an associated balancing transformer.

20. The illumination system of claim 19, wherein the turns ratio is a ratio of a number of secondary turns to a number of primary turns.

* * * * *